US006519421B2

(12) United States Patent
Inoue

(10) Patent No.: US 6,519,421 B2
(45) Date of Patent: Feb. 11, 2003

(54) ELECTROPHOTOGRAPHIC PRINTING APPARATUS USING DENSITY CONTROL

(75) Inventor: Hiroyuki Inoue, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 09/841,229

(22) Filed: Apr. 24, 2001

(65) Prior Publication Data

US 2001/0036370 A1 Nov. 1, 2001

(30) Foreign Application Priority Data

Apr. 27, 2000 (JP) ..... 2000-127299

(51) Int. Cl.[7] ..... G03G 15/00
(52) U.S. Cl. ..... 399/9; 399/15; 399/49
(58) Field of Search ..... 399/15, 18, 49, 399/72, 299, 9; 382/112

(56) References Cited

U.S. PATENT DOCUMENTS 5,294,959 A * 3/1994 Nagao et al. ..... 399/44
5,576,811 A * 11/1996 Kobayashi et al. ..... 399/15 X
6,243,542 B1 * 6/2001 Fujimoto et al. ..... 399/49

* cited by examiner

*Primary Examiner*—Sophia S. Chen
(74) *Attorney, Agent, or Firm*—Akin, Gump, Strauss, Hauer & Feld, L.L.P.

(57) ABSTRACT

An electrophotographic printer has a printing mechanism that prints data on a medium on a transport belt and is movable between operative and non-operative positions. The printing mechanism and a main body have mechanical contacts through which the printing mechanism receives electric power from the main body when the printing mechanism is at the operative position. A density sensor is located downstream of the printing mechanism with respect to a direction of travel of the transport belt and detects a density of the surface of the transport belt. A controller causes the printing mechanism to print a test pattern on the transport belt and compares a density of the printed test pattern with a density of print data of the test pattern. If there is a difference in density between the data of test pattern and the printed test pattern, the controller generates a reporting signal.

19 Claims, 10 Drawing Sheets

ELECTROPHOTOGRAPHIC PRINTING APPARATUS USING DENSITY CONTROL

BACKGROUND OF THE INVENTION

1. Field of the Invention

The present invention relates to printing apparatus such as electrophotographic copying machines and electrophotographic printers in which images are printed by electrophotography.

2. Description of the Related Art

A conventional printing apparatus of this type performs printing through a sequence of electrophotographic processes: charging, exposing, developing, transferring, and cleaning. The apparatus incorporates a print engine that takes the form of a unit assembly and performs printing operations.

For performing the aforementioned sequence of photographic operations, the print engine receives high negative voltages and high positive voltages from power sources provided in the main body of the printing apparatus. A charging roller receives a high negative voltage and other rollers including a developing roller receive low negative voltages.

The printing mechanism is removably attached to the main body. The printing mechanism and the main body have mechanical contacts such that when the printing mechanism is attached to the main body, the printing mechanism receives negative voltages through the mechanical contacts.

The contacts provided on the printing mechanism are, for example, electrically conductive plate-like members that are in contact with the end surface of an electrically conductive shaft of the respective rollers. The contacts provided on the main body are, for example, electrically conductive resilient plate-like members.

The aforementioned conventional printer suffers the following problems.

If the printing mechanism is repeatedly mounted on and dismounted from the main body over a long term use, the electrical contact members will be subjected to mechanical deformation and fatigue, or attract foreign materials such as toner particles and paper particles. Mechanical fatigue causes the contact members to lose resiliency.

As a result, even if the printing mechanism is attached properly into the main body, the electrical contact may not be properly made between the printing mechanism and the main body. Poor electrical contact causes problems such as improper sequence of electrophotographic processes and poor print quality. Prolonged poor electrical contact eventually leads to damages to the print engine, particularly to electrical and physical properties of the photoconductive drum. The present invention was made in view of the aforementioned problems.

BRIEF SUMMARY OF THE INVENTION

An electrophotographic printing apparatus includes at least one printing mechanism that prints on a print medium transported on a transport belt to the printing mechanism. The printing mechanism is movable between an operative position and a non-operative position thereof. The printing mechanism and the main body have mechanical contacts through which electric power is supplied from the main body to the printing mechanism when the printing mechanism is at the operative position. The apparatus also includes a density sensor and a controller. The density sensor is located downstream of the printing mechanism with respect to a direction of travel of the transport belt. The density sensor detects the density of a surface of the transport belt when a test pattern is printed on the transport belt. The controller causes the printing mechanism to print the test pattern on the transport belt. Then, based on the output of the density sensor, the controller performs a comparison operation in which a density of the printed test pattern is compared with a density of print data of the test pattern. When the controller detects a discrepancy in density between the data of test pattern and the printed test pattern during the comparison operation, the controller generates a reporting signal indicative of the discrepancy.

The controller may perform the comparison operation a certain number of times when the controller detects the discrepancy.

When the controller does not detect the discrepancy during the comparison operation, the controller enters a standby state where the printer waits for a print job.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE SEVERAL VIEWS OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

Embodiments of the invention will be described in detail with reference to the accompanying drawings.

First Embodiment

{Construction}

Figure 1:
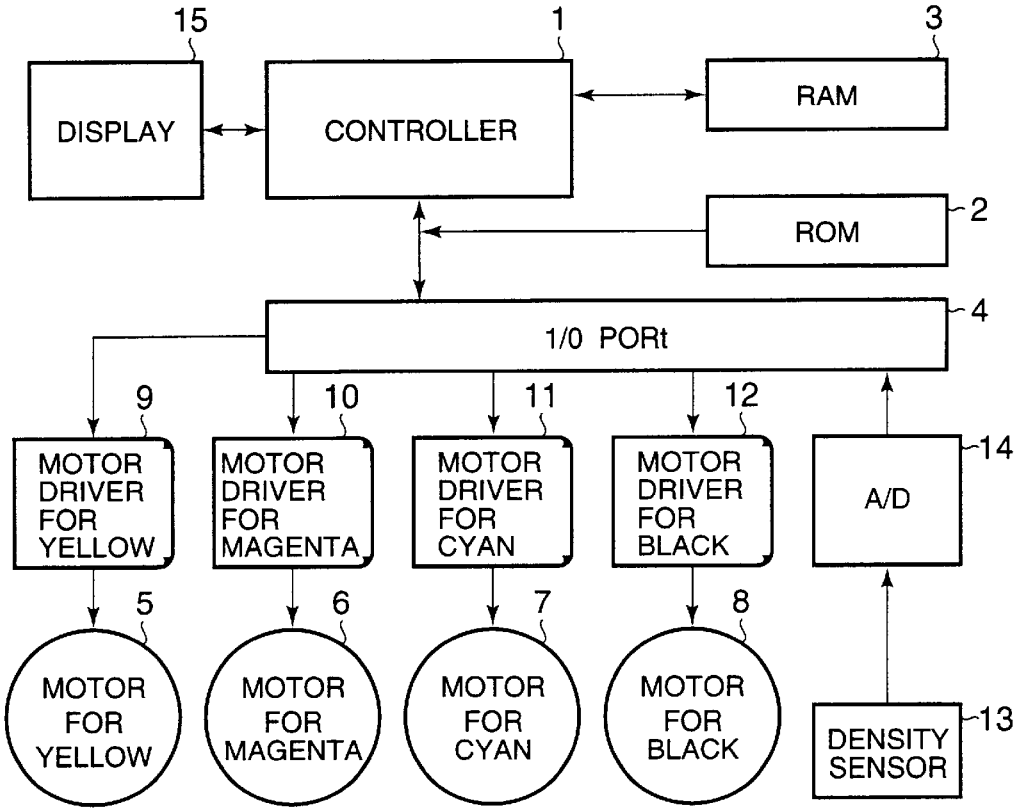
FIG. 1 is a block diagram illustrating an example of an electrophotographic printer according to the present invention.

FIG. 1 is a block diagram illustrating an example of an electrophotographic printer according to the present invention.

Referring to FIG. 1, a ROM 2 stores programs that are executed by a controller 1 in the form of a CPU, and various data such as print data of a test pattern. A RAM 3 is a working memory for the controller 1. The controller 1 communicates with motor drivers 9–12 and an A/D converter 14 via an I/O port 4. Under the control of the controller 1, the motor drivers 9–12 drive motors 5–8 to rotate print engines for yellow (Y), magenta (M), cyan (C), and black (K) images, respectively. The A/D converter 14 receives analog data from a density sensor 13 and converts the analog data into digital data. A display 15 is in the form of a display that cooperates with the controller 1 and ROM 2 to indicate various abnormal conditions and alarms to the user.

Figure 2:
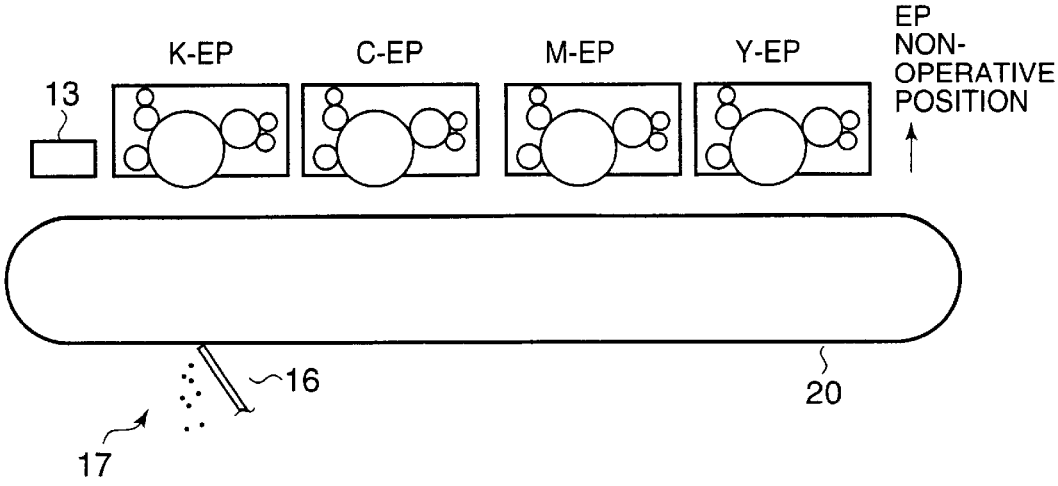
FIG. 2 illustrates the printer of FIG. 1 when printing mechanisms are raised from a ma body.

FIG. 2 illustrates the printer of FIG. 1 when printing mechanisms are raised to their non-operative positions from a main body of the printer.

Figure 3:
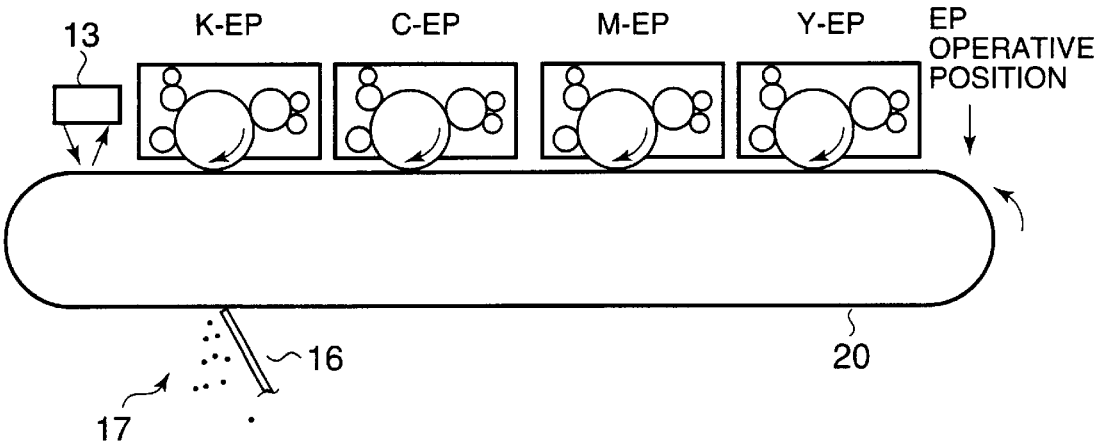
FIG. 3 illustrates the printer of FIG. 1 when the printing mechanisms are lowered to their operative positions.

FIG. 3 illustrates the printer of FIG. 1 when the printing mechanisms are lowered to their operative positions.

Referring to FIGS. 2 and 3, a belt 20 transports a print medium, not shown, such as print paper. Printing mechanisms Y-EP, M-EP, C-EP, are K-EP print images of corresponding colors on the print medium in the order of yellow (Y), magenta (M), cyan (C), and black (K). There is provided a cleaning blade 16 whose tip end is in contact with the belt 20 so that the toner 17 is scratched off the belt.

Figure 4:
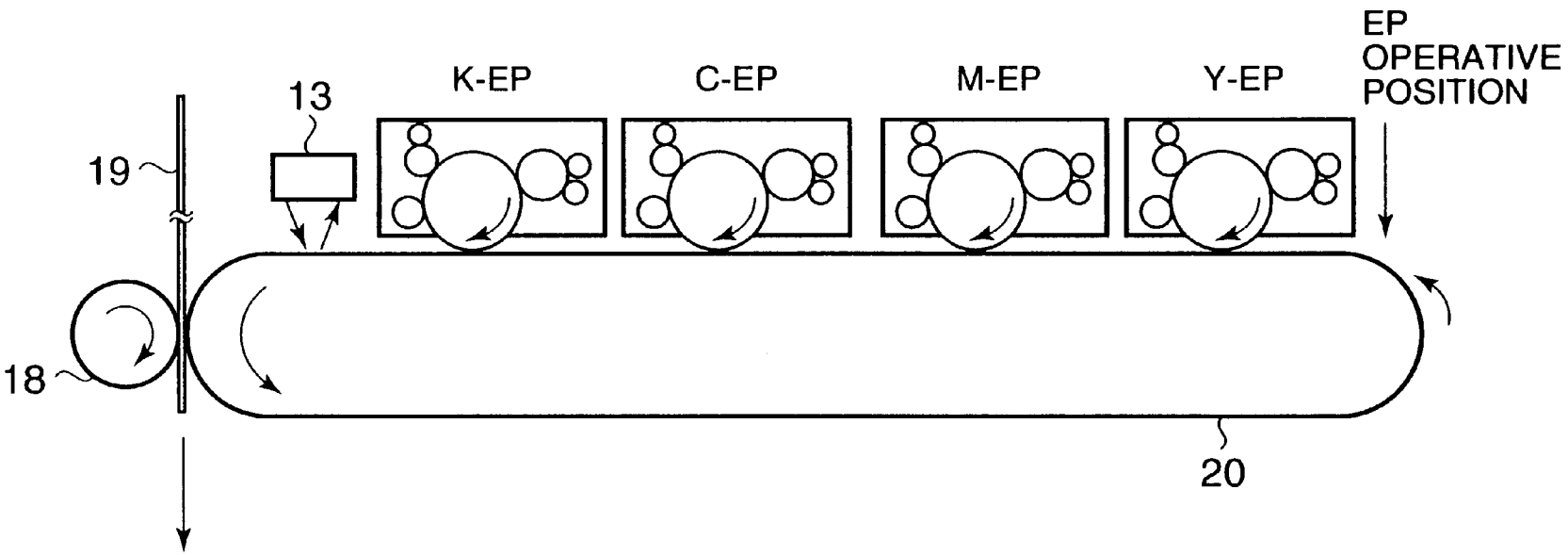
FIG. 4 illustrates another printer in which the belt takes the form of an intermediate transfer belt.

FIG. 4 illustrates another printer where the belt 20 takes the form of an intermediate transfer belt and a toner image on the intermediate transfer belt is transferred onto a print medium 19 that passes between a transfer roller 18 and the belt 20. The toner image on the intermediate transfer belt is transferred onto the print medium. The rest of the construction is the same as that of FIGS. 2 and 3.

The CPU sends out control signals to the motor drivers 9–12 for the motors 5–8 and receives digital signals from the A/D converter 14. The density sensor 13 is disposed beside the belt 20 and downstream of the printing mechanisms and detects the density of the surface of the belt 20.

Figure 5:
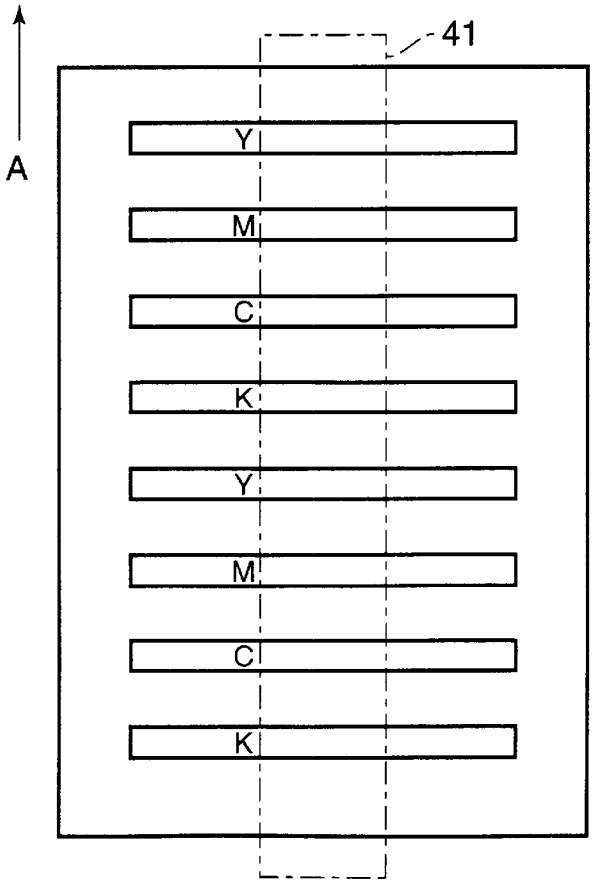
FIG. 5 illustrates an example of a test pattern.

FIG. 5 illustrates an example of a test pattern.

The test pattern includes a series of stripes of yellow, magenta, cyan, and black images that are aligned in this order. Each stripe extends in a direction perpendicular to a direction of travel of the belt shown by an arrow A. An area 41 in FIG. 5 enclosed by dot-dash lines is an area in which the density sensor 13 actually detects the densities of the stripes of the respective colors.

The ROM 2 stores a range in which the normal reflection coefficient of the belt varies. The ROM 2 also stores ranges $R_Y$, $R_M$, $R_C$, and $R_K$ in which the reflection coefficients of printed stripes of corresponding colors Y, M, C, and K vary when the test pattern is printed normally. The ranges of normal reflection coefficients are experimentally determined previously.

As the belt runs, the density sensor 13 reads the reflection coefficients of the respective stripes in sequence. The outputs of the density sensor 13 are reflection coefficients of the yellow stripe, belt, magenta stripe, belt, cyan strip, belt, and black stripe detected in this order. The A/D converter converts the outputs of the density sensor 13 indicative of the reflection coefficients of the respective stripes into digital signals in sequence. Then, the controller determines whether each digital signal falls in a corresponding range. The belt runs at a precisely controlled speed and therefore the controller can determine the length of time from when the controller 1 causes the RAM to output the print data of the test pattern till the density sensor 13 reads the reflection coefficients of the stripes of the test pattern printed on the belt. Thus, in synchronism with the outputs of the density sensor 13, the controller can determine whether each digital signal falls in a corresponding range. The ROM 2 stores a range in which the normal reflection coefficient of the print medium varies. The range of normal reflection coefficient of the print medium is experimentally determined previously. Thus, the printed image of the test pattern may also be properly detected to find out normal and abnormal operations of the printer.

The controller 1 compares the density of actual print result of a test pattern such as that of FIG. 5 with the ranges of normal reflection coefficients of the test pattern, thereby detecting any abnormal conditions. In this manner, the controller 1 determines whether there is an unwanted print within an area in which the print data should be printed or a missing print within an area in which the print data should be printed. If the density of actual print result of a test pattern falls outside the ranges of normal reflection coefficients, the display 15 displays a message indicative of abnormal condition.

The printing mechanisms Y-EP, M-EP, C-EP, and K-EP each include primarily a photoconductive drum, a charging roller, and a developing roller.

Referring to FIGS. 2 and 3, the belt 20 is a part of the main body while the printing mechanisms Y-EP, M-EP, C-EP, and K-EP are removable from the main body. The printing mechanisms may be configured such that they are movable laterally or vertically with respect to the main body and can be moved manually or driven automatically by a motor or the like. The printing mechanisms receive electric power from the main body through mechanical contacts between the main body and the printing mechanisms. The electrical contacts may be of point contact or surface contact.

Figure 6:
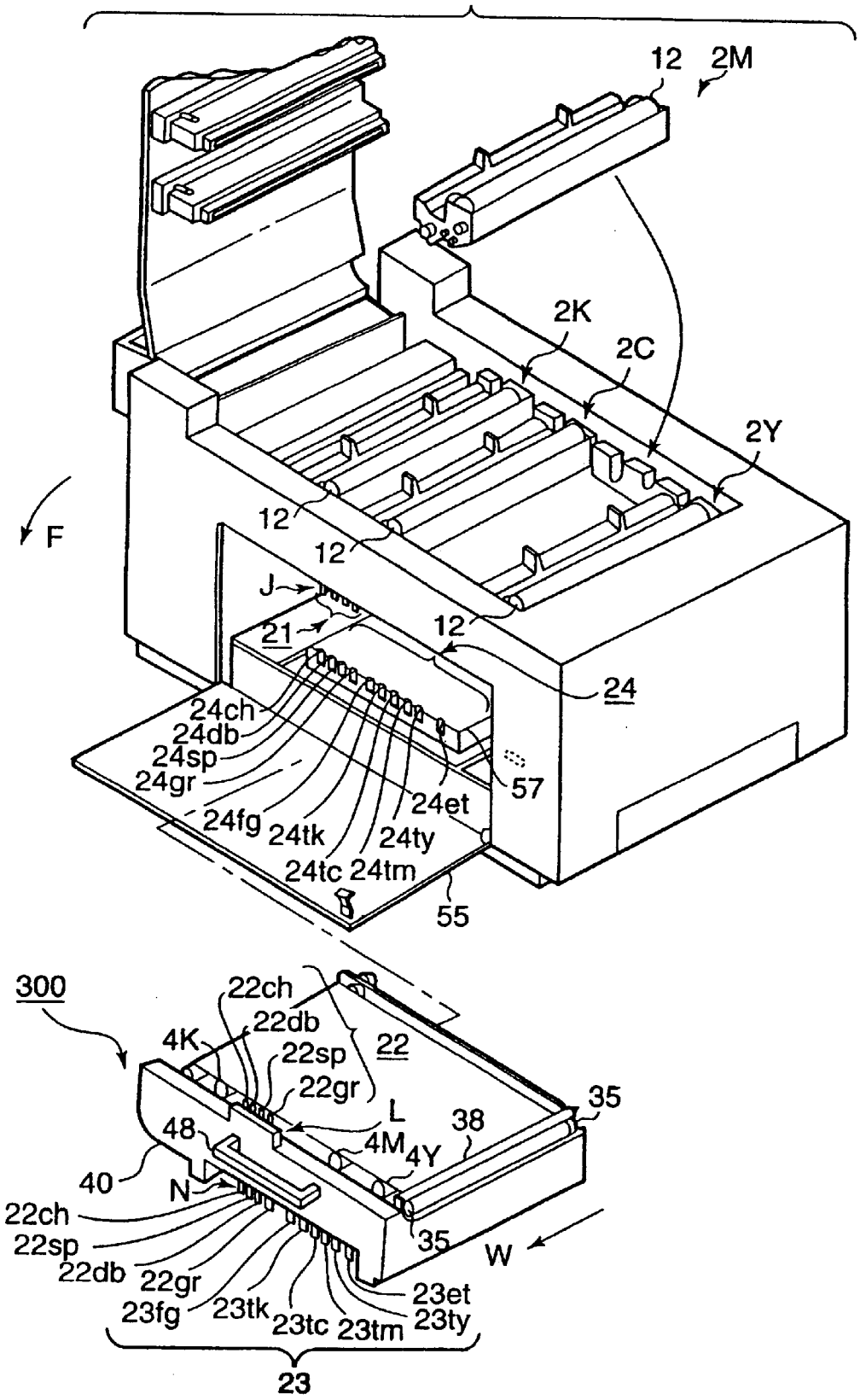
FIG. 6 is an exploded perspective view of the electrophotographic printer.

FIG. 6 is an exploded perspective view of the electrophotographic printer.

Referring to FIG. 6, the electrophotographic printer incorporates image-forming cartridges 2Y, 2M, 2C, and 2K that are aligned in a horizontal plane and detachably mounted to the main body. There is provided a high voltage power supply 57 below the image-forming cartridges 2Y, 2M, 2C, and 2K, and a belt unit 300 between the high voltage power supply 57 and the image-forming cartridges 2Y, 2M, 2C, and 2K. The belt unit 300 has a handle 48 provided on its side portion, so that a user can grip the handle 48 to pull out the belt unit 300 from the main body for maintenance. The electrophotographic printer has a side cover 55 hingedly mounted to the main body of the electrophotographic printer. For maintenance, the user opens the side cover 55 in a direction shown by arrow F and pulls out the belt unit 300 in a direction shown by arrow W.

The electrophotographic printer further has a main frame, not shown, that supports a bank 21 of conductive members.

The high-voltage power supply 57 supplies high voltages to the respective printing mechanisms through a high voltage contact bank 24. The high-voltage contact bank 24 includes contacts 24*ch*, 24*db*, 24*sp*, 24*gr*, 24*fg*, 24*tk*, 24*tc*, 24*tm*, 24*ty* and 24*et*.

The transfer belt unit 300 is provided with a bank 22 of electrically conductive relay members and a bank 23 of electrically conductive members, the bank 22 and bank 23 being securely held on a frame 40 of the transfer belt 300.

The high voltage power supply 57 supplies high voltages to the image forming cartridges 2Y, 2M, 2C, 2K through the banks 24 and 22, and to the transfer belt unit 300 through the banks 24 and 23.

Figure 7:
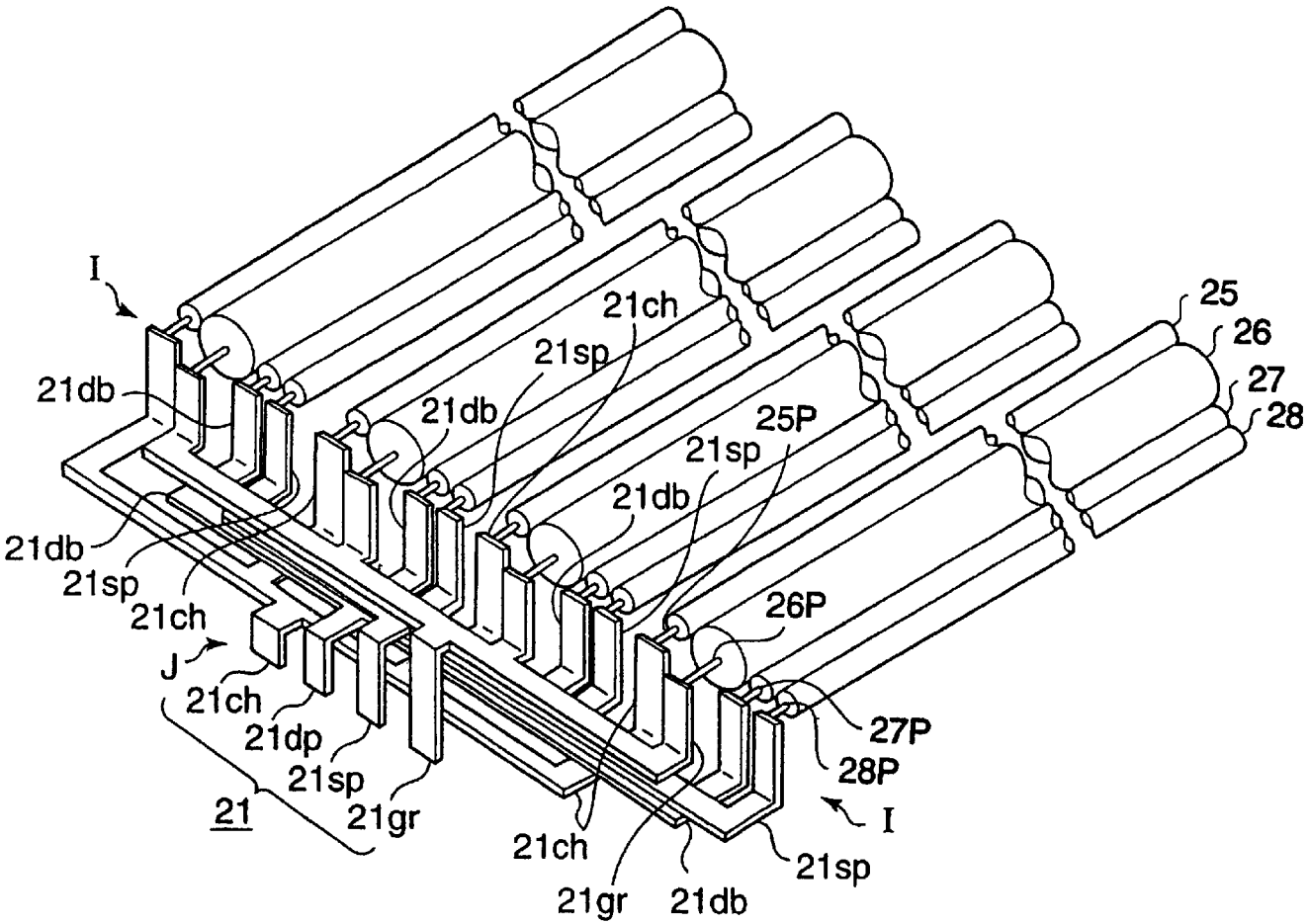
FIG. 7 is a perspective view illustrating the detail of the bank of conductive members.

FIG. 7 is a perspective view illustrating the detail of the bank 21.

The bank 21 is provided on the main body near the side cover 55, and includes conductive members 21*ch*, 21*db*, 21*sp*, and 21*gr*. Contact portions on one ends (indicated by arrow J) of the conductive members 21*ch*, 21*db*, 21*sp*, and 21*gr* are exposed when the side cover 55 is opened. Contact portions on the other end (indicated by arrow I) are brought into contact engagement with contacts, not shown, of the respective image forming cartridges 2M, 2Y, 2C, and 2K when the respective image forming cartridges 2M, 2Y, 2C, and 2K are placed in position in the printer.

As shown in FIG. 7, a CH voltage connecting member 21*ch* supplies a high voltage to the respective charging rollers 25 at charging roller ends 25P, and a DB voltage connecting member 21*db* supplies a high voltage to the respective developing rollers 27 at developing roller ends 27P. An SP voltage connecting member 21*sp* supplies a high voltage to the respective sponge rollers 28 at sponge roller ends 28P, and a ground connecting member 21*gr* connects the respective photoconductive drums 26 at photoconductive drum ends 26P to the ground.

The bank 22 is securely supported near the handle 48, and has four connecting members 22*ch*, 22*db*, 22*sp*, and 22*gr*. The connecting members 22*ch*, 22*db*, 22*sp*, and 22*gr* have upper ends (indicated by L) that upwardly project above the transfer belt and lower ends (indicated by N that downwardly project below the handle 48. Upon attaching the belt unit 300 into the printer, upper ends of the connecting members 22*ch*, 22*db*, 22*sp*, and 22*gr* are brought into contact engagement with the one ends of the conductive members 21*ch*, 21*db*, 21*sp*, and 21*gr*, respectively, and the lower ends of the connecting members 22*ch*, 22*db*, 22*sp*, and 22*gr* are brought into contact engagement with the contacts 24*ch*, 24*db*, 24*sp*, and 24*gr*, respectively The connecting member has five connecting members 23*et*, 23*ty*, 23*tm*, 23*tc*, 23*tk*, and 23*fg*. As shown in FIG. 6, the connecting members 23*et*, 23*ty*, 23*tm*, 23*tc*, 23*tk*, and 23*fg* have one ends (indicated by N) that downwardly project below the transfer belt, and the other ends that are in contact with the ends of shafts of the transfer rollers 4K, 4M, 4Y, and 4C (4C not shown).

An ET voltage-connecting member 23*et* supplies an attraction high voltage to the attraction rollers 38. A TY connecting member 23*ty* supplies a charging high voltage to transfer rollers 4Y. A TM connecting member 23*tm* supplies a charging high voltage to transfer rollers 4M. A TC voltage-connecting member 23*tc* supplies a charging high voltage to transfer rollers 4C. A TK connecting member 23*tk* supplies a charging high voltage to transfer rollers 4K.

An FG ground connecting member 23*fg* connects respective metal components of the transfer belt to a frame ground, not shown, of the printer. A driven roller 35 on which the transfer belt is entrained is connected to the ground through the FG ground-connecting member 23*fg*, so that the print medium is electrostatically attracted to the transfer belt by the potential between the attraction roller 38.

When the belt unit 300 is attached to the main body of the printer, the ET connecting member 23*et* has one end in contact with a high voltage supplying contact 24*et* provided on the high voltage power supply 57. The TY connecting member 23*ty* has one end in contact with the high voltage supplying contact 24*ch*. The TM connecting member 23*tm* has one end in contact with the high voltage supplying contact 24*tm*. The TK connecting member 23*tk* has one end in contact with the high voltage supplying contact 24*tk*. The ground-connecting ember 23*fg* has one end in contact with the high voltage supplying contact 24*fg*.

The ET connecting member 23*et* has the other end in contact with the end of the shaft of the attraction roller 38. The TY connecting member 23*ty* has the other end in contact with the end of the shaft of the transfer roller 4Y. The TM connecting member 23*tm* has the other end in contact with the end of the shaft of the transfer roller 4M. The TC connecting member 23*tc* has the other end in contact with the end of the shaft of the transfer roller 4C. The TK connecting member 23*tk* has the other end in contact with the end of the shaft of the transfer roller 4K. The respective banks 21, 22, 23, and 24 are formed of a metal material such as phosphor bronze that has electrical conductivity and mechanical resiliency.

{Operation}

The operation of the printer of the aforementioned construction will be described.

First, the operation will be described with reference to FIGS. 8 and 9 with respect to a case where poor electrical connection occurs in a contact through which the charging roller receives a high voltage.

Figure 8:
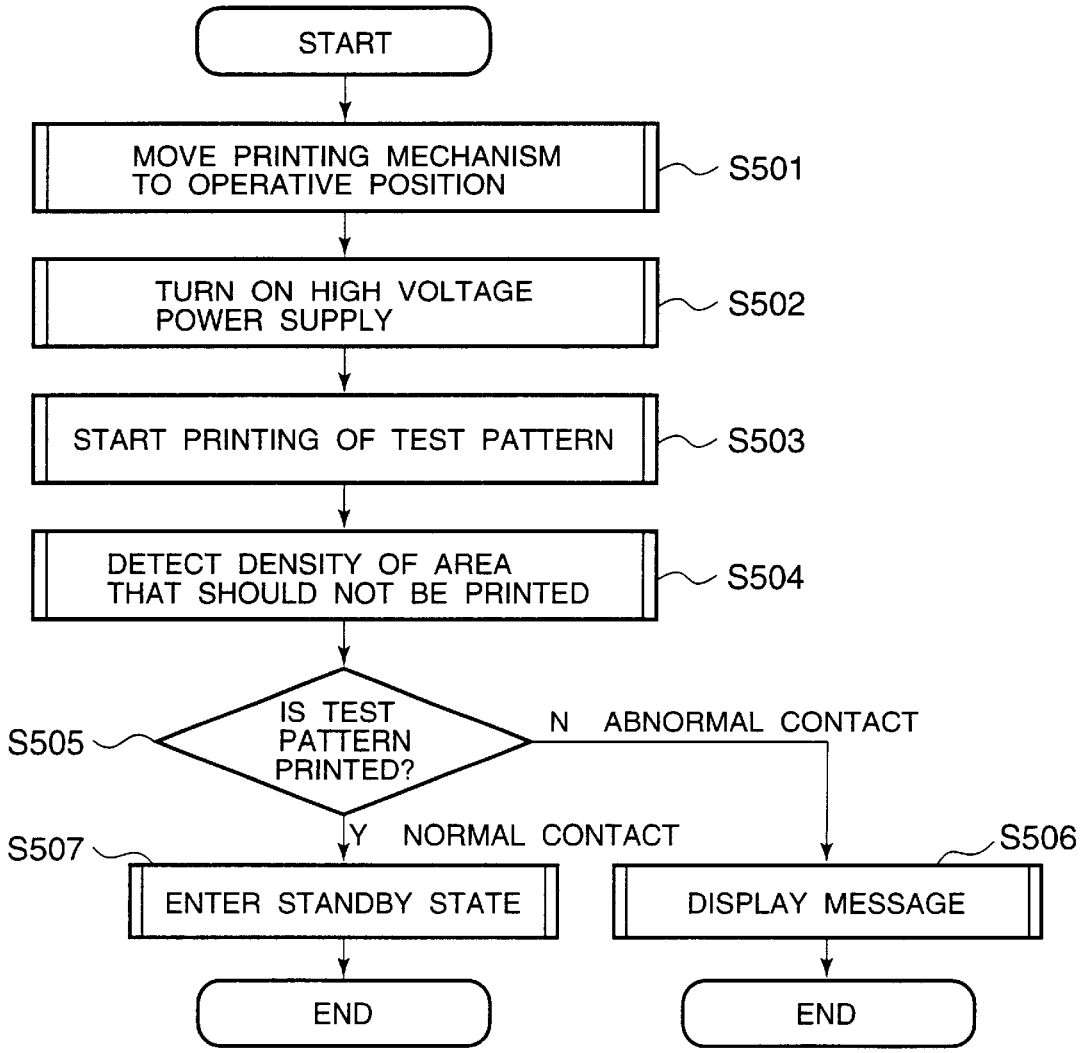
FIG. 8 is a flowchart illustrating the operation of the invention.

FIG. 8 is a flowchart illustrating the operation of the invention.

Referring to FIG. 8, upon power up, the printing mechanisms are raised from the main body and then lowered to the main body (step S501). At step S501, printing mechanisms of specified colors for printing are set at their operative positions and printing mechanisms of colors not required are set at their non-operative positions (raised positions). This selective setting of printing mechanisms prevents undesired color from being printed and decreases chance of high voltage noises being developed due to unnecessary electrical contacts. When a printing mechanism is raised from its operative position to its non-operative position, the photoconductive drum moves out of contact engagement with the belt 20 and the electrical contacts move out of contact engagement with those on the main body.

The controller 1 causes a negative high voltage power supply, not shown, to turn on, so that the print data stored in the RAM 3 is used to print the test pattern of FIG. 5 (steps S502–S503). The test pattern includes printed belt-shaped areas of Y, M, C and K disposed in this order with non-printed belt-shaped areas between adjacent printed belt-shaped areas. The non-printed belt shaped areas are areas in which the test pattern is not to be printed if electrical contacts are normal. Then, the controller reads the output of the density sensor 13 to detect the density of the non-printed belt-shaped areas, i.e., density of the belt surface (S504).

The density of unwanted printed area varies depending on which printing mechanism has poor electrical connection with the main body. In any case, detection of the density levels 71 and 72 clearly indicates that there exists poor electrical connection between that printing mechanism and the main body (step S505).

Figure 9:
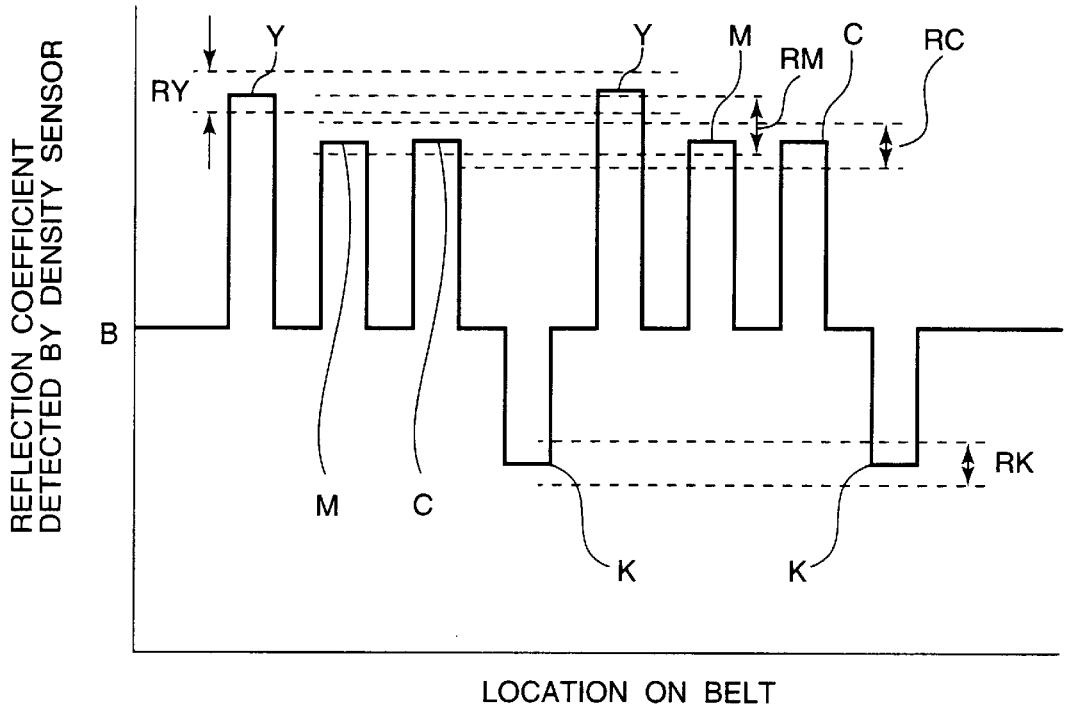
FIG. 9 illustrates reflection coefficients of belt-shaped printed areas of the respective colors, detected by a density sensor.

FIG. 9 illustrates standard values of reflection coefficients of belt-shaped printed areas of the respective colors, detected by a density sensor.

The density sensor 13 detects the density of this test pattern. If the electrical contacts between the printing mechanisms and the main body 22 are normal, then printing is performed normally. Thus, the controller 1 does not detect any missing print within an area that should be printed, and the detection results are those of FIG. 9. FIG. 9 plots belt-shaped printed areas of the respective colors as the abscissa and reflection coefficients detected by the density sensor 13 as the ordinate. The reflection coefficient varies with factors such as the sensitivity of the sensors, the intensity of light that illuminates the printed test pattern, and characteristics of toner. Ranges $R_Y$, $R_M$, $R_C$, and $R_K$ denote ranges in which the reflection coefficients vary normally due to these factors. Reference B denotes the reflection coefficient of the belt.

Figure 10:
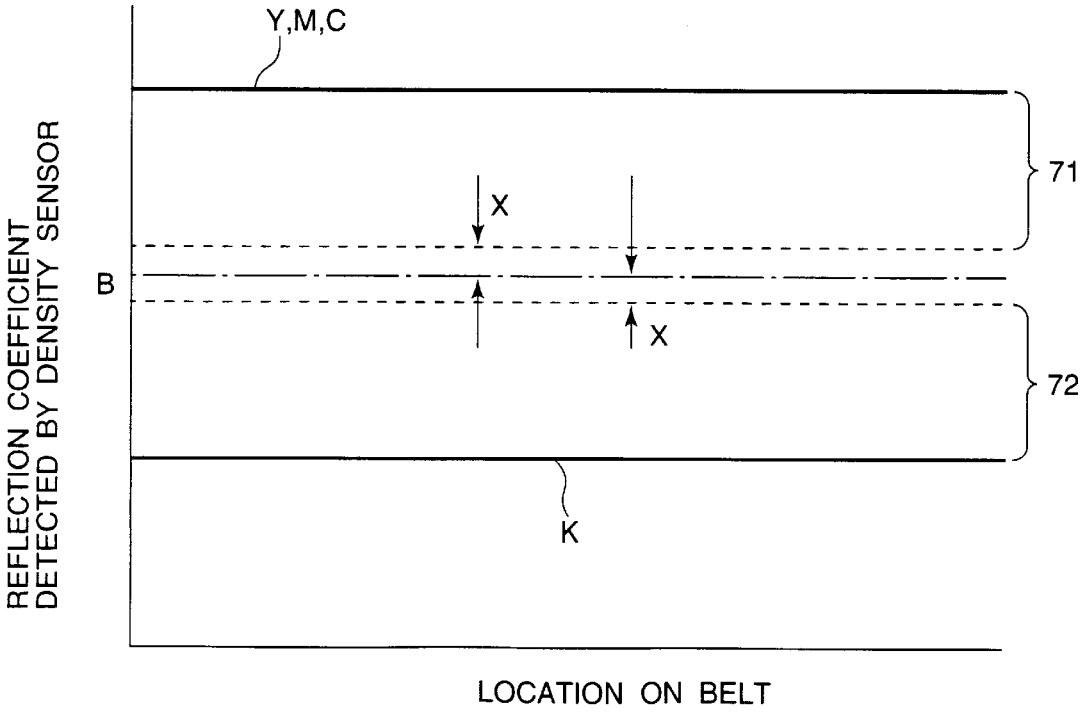
FIG. 10 illustrates ranges in which the densities of yellow, magenta, cyan, and black patterns vary depending on the degree of poor electrical contact.

FIG. 10 illustrates ranges in which the densities of yellow, magenta, cyan, and black patterns vary depending on the degree of poor electrical contact.

Poor electrical connection between the print engines and the main body causes some unwanted print to appear in an area that should not be printed, so that the area has a density (reflection coefficient 71 or 72 of FIG. 10) between normally printed areas and the belt 20. Reference B denotes the reflection coefficient of the belt.

{Poor Electrical Contact at the Charging Unit}

The following is the explanation of why poor electrical contact causes some undesired print to appear in an area that should not be printed.

Figure 11A:
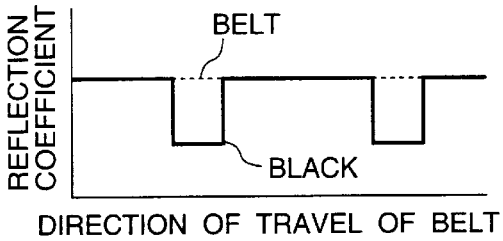
FIG. 11A illustrates a change in reflection coefficient when electrical connection between the main body and the printing mechanism for black image is normal.

FIG. 11A illustrates a change in reflection coefficient when electrical connection between the main body and the printing mechanism for black image is normal.

Figure 11B:
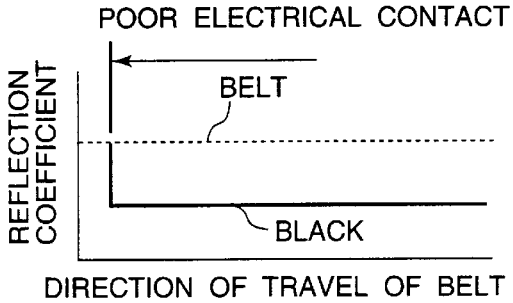
FIG. 11B illustrates a change in reflection coefficient when poor electrical connection has occurred between the main body and the printing mechanism for black image.
Figure 11C:
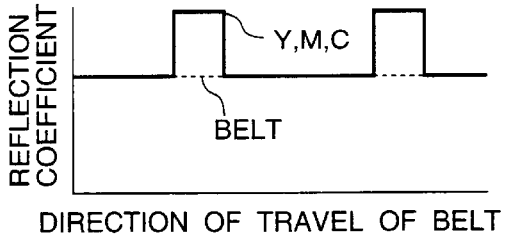
FIG. 11C illustrates a change in reflection coefficient when electrical connection between the main body and the printing mechanisms for yellow, magenta, and cyan images is normal.

FIG. 11C illustrates a change in reflection coefficient when electrical connection between the main body and the printing mechanisms for yellow, magenta, and cyan images is normal.

When printing is performed normally, the charging roller receives a high negative voltage of −1350 V so that the surface of the photoconductive drum in contact with the charging roller is charged to about −800 V. The photoconductive drum rotates and the surface charged to −800 V arrives at an exposing station. An exposing unit illuminates the charged surface in accordance with the print data to form an electrostatic latent image on the photoconductive drum. The potential of the illuminated areas becomes about zero volts. The photoconductive drum further rotates so that the exposed areas reach the developing roller. Since the developing roller receives a negative voltage of −250 V, the negatively charged toner particles migrate from the developing roller to the exposed areas on the photoconductive drum, thereby developing the electrostatic latent image into a toner image. The surface of the photoconductive drum, except the exposed areas, remains negatively charged and therefore no toner particles migrate to the non-exposed areas. Thus, the printing is performed normally as shown in FIGS. 11A and 11C.

FIG. 11B illustrates a change in reflection coefficient when poor electrical connection has occurred between the main body and the printing mechanism for black image.

Figure 11D:
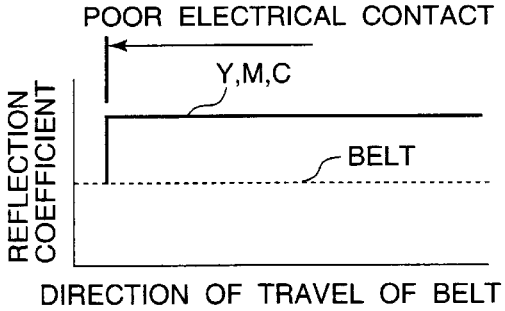
FIG. 11D illustrates a change in reflection coefficient when poor electrical connection has occurred between the main body and the printing mechanisms for color images.

FIG. 11D illustrates a change in reflection coefficient when poor electrical connection has occurred between the main body and the printing mechanisms for color images.

If poor electrical connection occurs at contacts between the main body and the electrode for the charging roller of the printing mechanism, the charging roller may not properly receive a negative voltage of −1350 V. As a result, the surface of the photoconductive drum is not charged to −800 V For example, if the charging roller receives no voltage due to poor contact between the printing mechanism and the main body, the entire surface of the photoconductive drum will become zero volts. Thus, the negatively charged toner particles migrate from the developer roller to the entire surface of the photoconductive drum, causing undesired print to appear in an area that should not be printed as shown in FIGS. 11B and 11D.

Referring back to FIG. 10, reflection coefficient B+X is a threshold level above which the controller determines that electrical connections are poor between the main body and the printing mechanisms for yellow, magenta, and cyan images. Reflection coefficient B−X is a threshold level below which the electrical connection between the main body and the printing mechanism for black image is determined to be poor.

If reflection coefficient above B+X or below B−X is detected in an area that should not be printed, the controller 1 causes the display 15 to display a message that there exists a poor contact between the printing mechanism and the main body 22 (step S506). If reflection coefficient above B+X or below B−X is not detected in an area that should not be printed, the controller 1 brings the printer into a standby state where the printer waits for print data (step S507).

{Poor Electrical Contact at the Developing Unit}

The following is the explanation of why poor electrical contact causes some missing prints to appear in an area that should be printed.

Figure 12A:
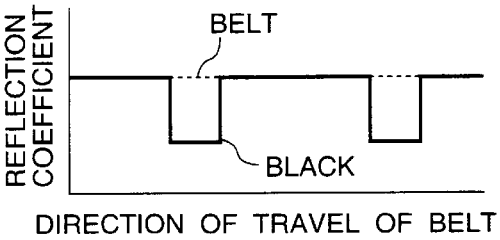
FIG. 12A illustrates a change in reflection coefficient when electrical connection between the main body and the printing mechanism for black image is normal.

FIG. 12A illustrates a change in reflection coefficient when electrical connection between the main body and the printing mechanism for black image is normal.

Figure 12B:
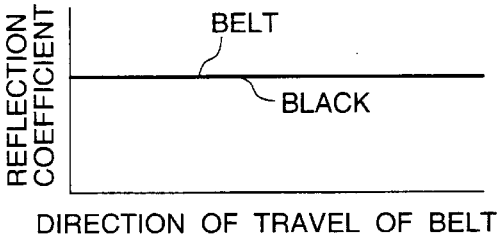
FIG. 12B illustrates a change in reflection coefficient when poor electrical connection has occurred between the main body and the print engines for black image.
Figure 12C:
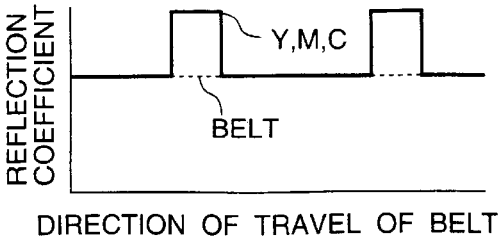
FIG. 12C illustrates a change in reflection coefficient when electrical connection between the main body and the printing mechanisms for yellow, magenta, and cyan images is normal.

FIG. 12C illustrates a change in reflection coefficient when electrical connection between the main body and the printing mechanisms for yellow, magenta, and cyan images is normal.

If poor electrical connection exists between the print engine and the main body at the contacts through which the developing roller receives a voltage, the developing roller cannot receive the voltage of −250 V. If the developing roller receives no voltage at all, the potential of the developing roller becomes about zero volts. Thus, the exposed areas on the photoconductive drum and the developing roller are substantially zero volts. As a result, neither the surface of the photoconductive drum charged to −800 V nor the exposed areas of the photoconductive drum receive toner particles, and no toner image is deposited to the area that should be printed. Thus, the reflection coefficient or the output of the density sensor 13 remains high for black printing and low for yellow, magenta, and cyan.

FIG. 12B illustrates a change in reflection coefficient when poor electrical connection has occurred between the main body and the print engines for black image.

Figure 12D:
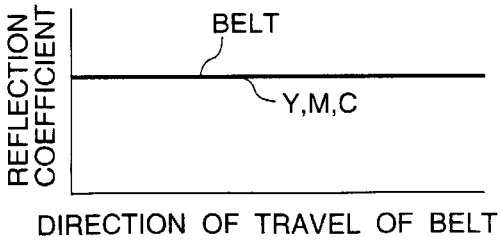
FIG. 12D illustrates a change in reflection coefficient when poor electrical connection has occurred between the main body and the print engines for color image.

FIG. 12D illustrates a change in reflection coefficient when poor electrical connection has occurred between the main body and the print engines for color image.

The operation will be described with reference to FIGS. 13 and 14 with respect to a case where poor electrical connection occurs in the contacts through which rollers other than the charging roller receive voltages.

Figure 13:
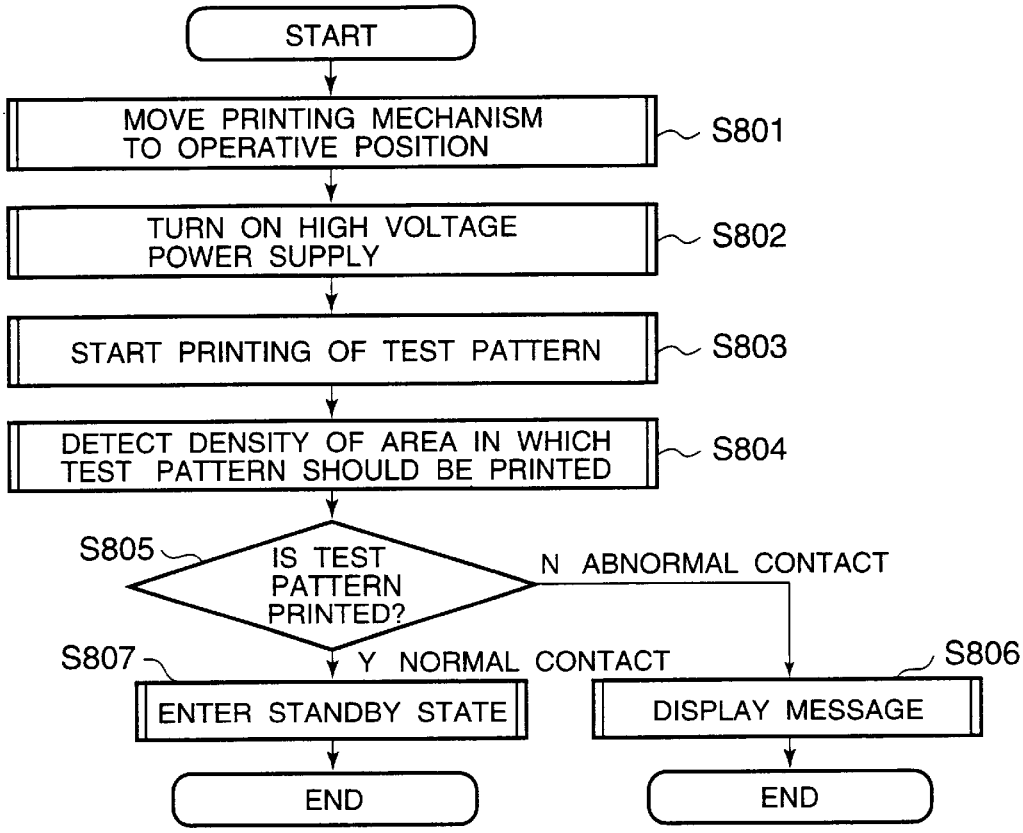
FIG. 13 is a flowchart illustrating the operation of the invention.

FIG. 13 is a flowchart illustrating the operation of the invention.

Figure 14:
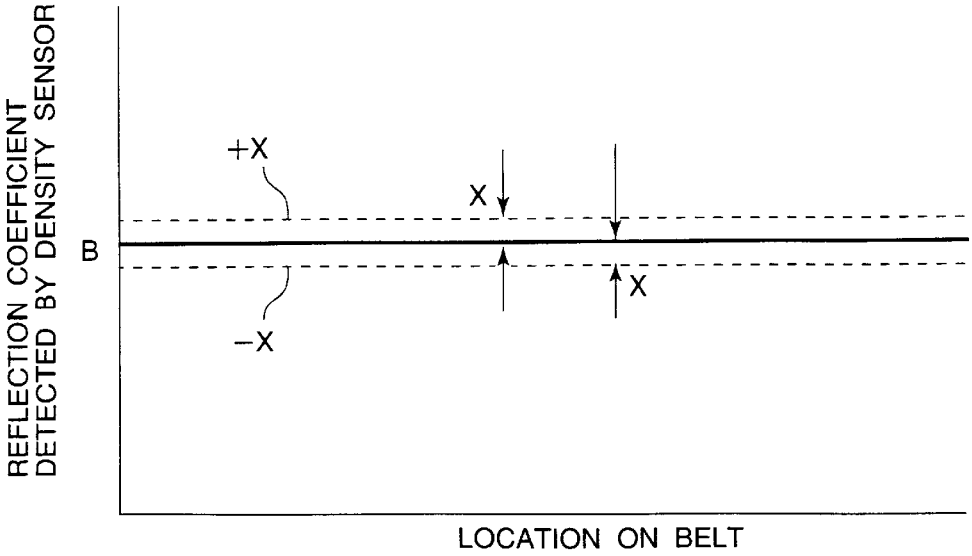
FIG. 14 illustrates ranges in which the densities of yellow, magenta, cyan, and black patterns vary depending on the degree of poor electrical contact.

FIG. 14 illustrates ranges in which the densities of yellow, magenta, cyan, and black patterns vary depending on the degree of poor electrical contact.

Steps S801–S803 of FIG. 13 are the same as steps S501–S503 of FIG. 8. Thus, only operation performed at steps S804 onward will be described.

At step S804, the density sensor 13 detects the density of an area of the test pattern that should be printed. If poor electrical connection exists between the printing mechanism and the main body 22 at contacts except for the contact through which the charging roller receives the high voltage, an area of the test pattern that should be printed has substantially the same density as the belt 20. In other words, referring to FIG. 14, the reflection coefficients are either between B and B+X or between B and B−X.

If a detected reflection coefficient is between B+X and B−X, it is determined at step S805 that there exists poor electrical connection between the printing mechanism and the main body at a contact except for the contact through which the charging roller receives a voltage.

Then, the controller 1 causes the display 15 to display a message that there exists poor electrical connection between the print mechanism and the main body at a contact other than the contact through which the charging roller receives the high voltage (step S806). If it is determined at step S805 that poor electrical connection does not exist between the print mechanism and the main body at a contact other than the contact through which the charging roller receives the high voltage, the controller 1 sets the printer in the standby state (step S807).

The present invention can detect poor contact between the printing mechanism and the main body before the contacts are seriously damaged such as loss of resiliency and plastic deformation of contact electrodes.

Second Embodiment

A second embodiment differs from the first embodiment in that the test pattern is printed on a print medium transported on the belt 20.

When abnormal printing operations in which unwanted print and/or missing print is detected, the abnormal printing operation may alternatively be indicated to the user as follows:

In other words, after the printing mechanisms are moved to their operative positions and non-operative positions, a test printing operation in which the aforementioned test pattern is printed is performed a predetermined number of times. If no abnormal condition is detected or abnormal condition is cleared, then the printing mechanism enters the standby state. If an abnormal condition remains after performing the test printing the predetermined times, the display 15 displays a corresponding message.

Figure 15:
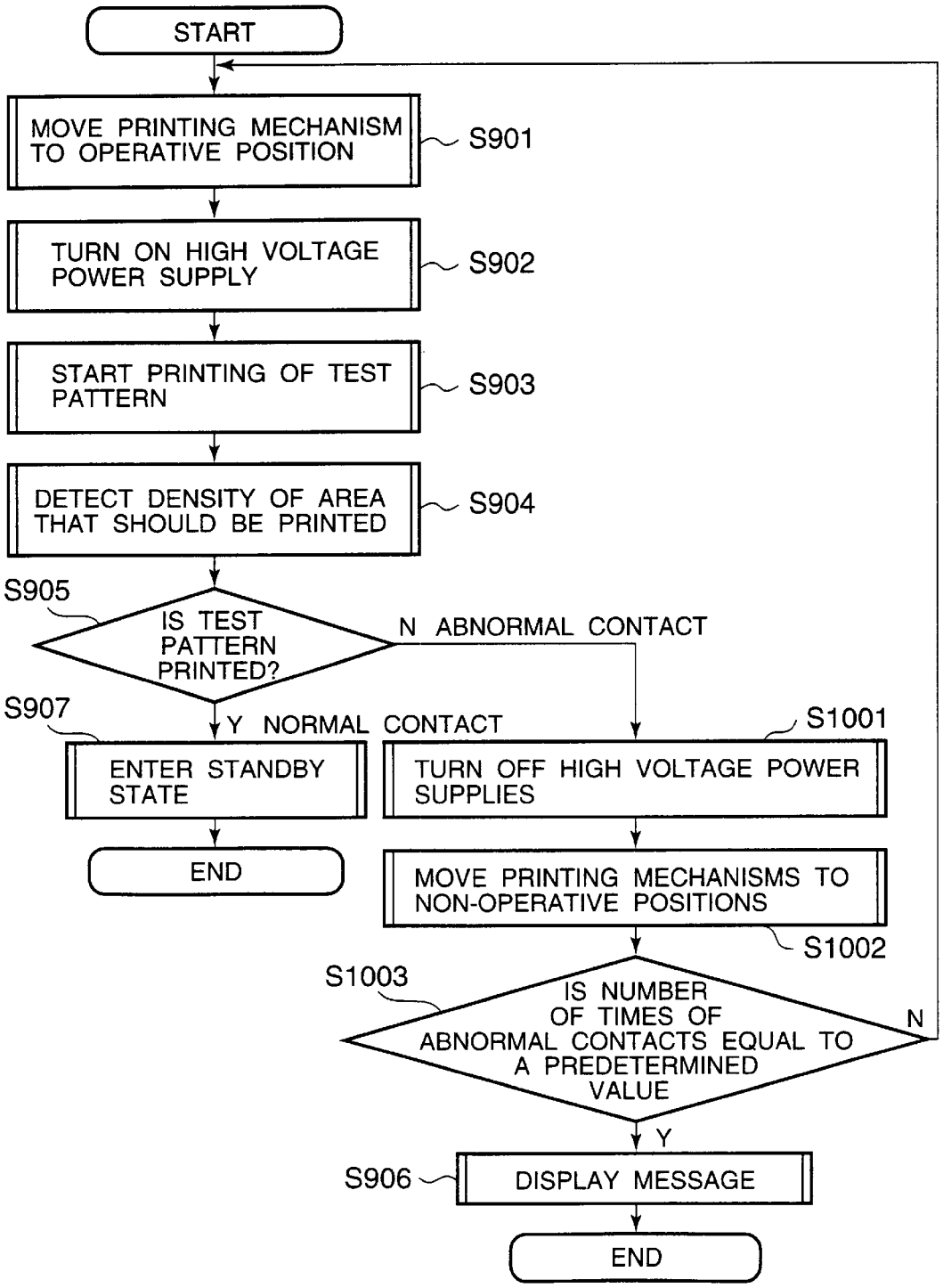
FIG. 15 is a flowchart illustrating an alternative operation of the invention.

FIG. 15 is a flowchart illustrating the aforementioned alternative operation.

The steps S901–S907 of FIG. 15 are the same as S501–S507 of FIG. 8, and have been given the same step numbers.

At step S905, if the answer is NO, then the program proceeds to step S1001 where the high voltage power supplies are turned off. At step S1002, the printing mechanisms are raised from their operative positions to their non-operative positions. At step S1003, it is determined whether the number of times of the detection of abnormal condition is equal to a predetermined number of times. If the answer is YES at step S1003, then the display 15 displays a message indicative of the occurrence of abnormal condition. If the answer is NO at step S1003, then the program jumps back to step S901 where the printing mechanisms are moved from their non-operative positions to their operative positions.

Making a plurality of decisions described through steps S901–S905 and S1001–S1003 not only prevents erroneous determination of poor contacts and but also provides chance of poor contacts being cleared through successive mechanical contacts and non-contacts.

In the aforementioned first and second embodiments, the indication of abnormal condition is effected by means of the display 15 but may be effected by a combination of the display 15 and, for example, a buzzer. Moreover, the test pattern may be printed on a print medium instead of the transport belt.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. An electrophotographic printing apparatus, comprising:

at least one printing mechanism that prints an image of print data;

a detector that reads a density of the image of print data printed by said printing mechanism; and a controller that performs a comparison operation in which the density of the image of the print data printed by said printing mechanism is compared with a reference density corresponding to the print data to determine whether printing is performed abnormally.

2. The electrophotographic printing apparatus according to claim 1, further comprising a transfer unit, wherein when said printing mechanism and the transfer unit are close together, said printing mechanism is ready to print;

wherein when said printing mechanism and the transfer unit are away from each other, said printing mechanism is not ready to print.

3. The electrophotographic printing apparatus according to claim 2, wherein the image of print data is printed on a print medium that is transported by said printing mechanism and the transfer unit.

4. The electrophotographic printing apparatus according to claim 2, wherein electrical connection is made between a main body of the apparatus and said printing mechanism at least when said printing mechanism and the transfer unit are close together;

wherein when said controller determines that a difference between the density of the image of the print data printed by said printing mechanism and the reference density corresponding to the print data is greater than a threshold value, said controller causes said printing mechanism and the transfer unit to move way from each other and subsequently to move close together; and wherein said controller causes said printing mechanism to print the image of the print data and compares the density of the printed image of the print data with the reference data corresponding to the print data to determine whether printing is performed normally.

5. The electrophotographic printing apparatus according to claim 2, wherein said controller determines that printing is being performed normally if a difference between the density of the printed image of the print data and the reference density corresponding to the print data is less than a certain value.

6. The electrophotographic printing apparatus according to claim 2, wherein the transfer unit includes a transport belt, wherein when said printing mechanism and the transfer unit are close together, said printing mechanism receives electric power from a main body of the apparatus through mechanical contacts between said printing mechanism and the main body;

wherein said detector is located downstream of said printing mechanism with respect to a direction of travel of the transport belt, the detector detecting a density of a surface of the transport belt; and wherein the image of the print data is a test pattern of the print data and said controller causes said printing mechanism to print the test pattern on the transport belt and performs a comparison operation in which a difference between a density of the test pattern printed by said printing mechanism and a reference density corresponding to the test pattern is determined;

wherein when said controller determines that the difference is greater than a certain value, said controller generates a reporting signal indicative of the difference.

7. The electrophotographic printing apparatus according to claim 2, wherein said controller performs the comparison operation a certain number of times when a difference between a density of the test pattern printed by said printing mechanism and a reference density corresponding to the test pattern is larger than a certain value.

8. The electrophotographic printing apparatus according to claim 7 wherein when a difference between a density of the test pattern printed by said printing mechanism and a reference density corresponding to the test pattern is smaller than the certain value, said controller enters a standby state where the apparatus waits for a print job.

9. The electrophotographic printing apparatus according to claim 2, wherein the image is printed on the transfer unit.

10. The electrophotographic printing apparatus according to claim 9, wherein the transfer unit includes a transport belt that runs through said printing mechanism and the image is printed on the transport belt.

11. The electrophotographic printing apparatus according to claim 1, wherein the print data describes a first area that should be printed and a second area that should not be printed, wherein said controller performs a comparison operation in which a density of a third area of a transport belt corresponding to the second area detected by said detector is compared with a reference density corresponding to the second area of the print data to determine whether the printing is performed abnormally.

12. The electrophotographic printing apparatus according to claim 11, further comprising a memory that stores a density of the second area when printing is performed normally, wherein said controller indicates to an operator when a difference between the density of the third area detected by said detector and the reference density is larger than a certain value.

13. The electrophotographic printing apparatus according to claim 12, further comprising a charging device that charges a photoconductor, wherein if the difference is more than a certain value, the controller determines that the charging device is operating abnormally.

14. The electrophotographic printing apparatus according to claim 13, wherein when the controller determines that the apparatus is operating abnormally, electrical contact is abnormal at the charging device.

15. The electrophotographic printing apparatus according to claim 11, further comprising a transfer unit, wherein when said printing mechanism and the transfer unit are close together, said printing mechanism is ready to print;

wherein when said printing mechanism and the transfer unit are away from each other, said printing mechanism is not ready to print;

wherein said controller indicates to an operator when a difference between the density of the image of the print data printed by said printing mechanism and the reference density corresponding to the print data is larger than a certain value.

16. The electrophotographic printing apparatus according to claim 1, further comprising a memory that stores a range defined by a maximum value and a minimum of the reference density, wherein said controller determines whether the density of the image of the print data printed by said printing mechanism is within the range.

17. The electrophotographic printing apparatus according to claim 16, wherein if the density of the image of the print data printed by said printing mechanism is within the range, said controller determines that printing is performed abnormally.

18. The electrophotographic printing apparatus according to claim 17, further comprising a charging device, wherein the print data describes a first area that should be printed and a second area that should not be printed, wherein if a density of the image of the print data that is printed by said printing mechanism corresponding to the second area is within a certain range, the controller determines that the electrical contact is abnormal except at the charging device.

19. The electrophotographic printing apparatus according to claim 18, further comprising a developing device, wherein electrical contact is abnormal at the developing device.

* * * * *